United States Patent [19]

Goldhammer

[11] Patent Number: 4,637,560

[45] Date of Patent: Jan. 20, 1987

[54] MACHINE FOR COMMINUTING MATERIALS, SUCH AS DOCUMENTS PARTICULARLY A SHREDDING MACHINE

[75] Inventor: Albert Goldhammer, Ueberlingen, Fed. Rep. of Germany

[73] Assignee: Fernwerktechnik Schleicher & Co., Fed. Rep. of Germany

[21] Appl. No.: 848,904

[22] Filed: Apr. 4, 1986

Related U.S. Application Data

[63] Continuation of Ser. No. 594,671, Mar. 25, 1984, abandoned.

[30] Foreign Application Priority Data

Apr. 12, 1983 [DE] Fed. Rep. of Germany ..... 3312992

[51] Int. Cl.[4] ..... B02C 19/00; B02C 23/00

[52] U.S. Cl. ..... 241/100; 241/101.7; 241/285 A

[58] Field of Search ..... 241/100, 101.2, 101.7, 241/285 R, 285 A, 285 B

[56] References Cited

U.S. PATENT DOCUMENTS

| | | | |
|---|---|---|---|
| 2,074,438 | 3/1937 | Swedman | 211/88 X |
| 2,343,757 | 3/1944 | Egedal | 241/100 X |
| 2,691,338 | 10/1954 | Robbins | 241/100 X |
| 3,221,997 | 12/1965 | Smit | 241/100 X |
| 3,682,402 | 8/1972 | Goldhammer | 241/100 |
| 4,212,431 | 7/1980 | Doyel | 241/100 |
| 4,257,565 | 3/1981 | Hatanaka | 241/100 |

*Primary Examiner*—Howard N. Goldberg
*Assistant Examiner*—Timothy V. Eley
*Attorney, Agent, or Firm*—Steele, Gould & Fried

[57] ABSTRACT

A shredding machine has a casing comprising an upper casing part, which is higher than the lower casing part, which has set back side walls compared with the upper casing part. Between the two casing parts is formed a supporting shoulder on which the machine is received in the opening of a frame of a stand. It can also be located on the supporting shoulder in the insertion opening of a built-in plate. Holders for a reception container for comminuted material are provided on the bottom of the lower casing part. An upwardly directed step close to the top of the machine permits a substantially surface-flush installation into a built-in plate.

10 Claims, 3 Drawing Figures

MACHINE FOR COMMINUTING MATERIALS, SUCH AS DOCUMENTS PARTICULARLY A SHREDDING MACHINE

This is a continuation of application Ser. No. 594,671, filed Mar. 28, 1984, now abandoned.

BACKGROUND OF THE INVENTION

The invention relates to a machine for comminuting materials, such as documents, etc., particularly a shredding machine with a casing. Such shredding machines usually have a box-like casing with a feed opening for the material to be comminuted at the front or top and a discharge opening for the comminuted material to the back or bottom.

Machines constructed as table models feed the comminuted material into a container, positioned behind one table edge. Models installed on a stand or cabinet eject the comminuted material through an opening into a basket or container located in the cabinet. There are also machines which can be directly installed on a wastepaper basket and discharge the comminuted material into the latter.

SUMMARY OF THE INVENTION

The object of the invention is to provide a machine with universal installation possibilities.

According to the invention this object is achieved in that the casing has an upper casing part with larger dimensions than the lower casing part, a supporting shoulder is formed between the casing parts and on the bottom of the lower casing part is provided a discharge opening for the comminuted material and a holder for a container for the comminuted material.

Thus, the machine can not only be set up in the conventional manner, but can also be fitted into an insertion opening of a built-in plate or countertop. The lower casing part, which preferably has at least a quarter of the overall height of the casing, projects below the built-in plate plane and the container for the comminuted material is fitted to a machine part and not to the stand. Thus, the stand merely has a carrying function and need not be especially prepared for the machine, except that it is necessary to provide an insertion opening of an appropriate size, whose edge forms a frame for receiving the supporting shoulder. This frame can also be provided on a framework formed from profiles, particularly square tubes. Due to the fact that built-in frame or plate covers the lower casing part, the installed machine appears more squat and the insertion opening is lower, so that it can be more easily reached. Wall fitting with a wall bracket which is L-shaped in side view is also possible.

The preferably plastic casing parts can be separable from one another in the vicinity of the supporting shoulder, so that the casing separating plane is concealed in the vicinity of said shoulder and cannot be seen from the outside. Moreover, the casing base also forms a base or assembly plate which is easily accessible during installation and on which it is possible to easily fit with good accessibility the individual mechanical parts, such as the cutting mechanism, the motor, the control units, etc. As a result of the trough shape with outwardly directed supporting shoulder and an upwardly directed edge which is preferably connected thereto, the lower casing part has an adequate stability for this function. This can be further improved in that the substantially planar bottom of the lower casing part is profiled and/or ribbed. The mechanical parts installed on the lower part of the casing are subsequently covered by the upper casing part, which overlaps the upwardly directed edge. Thus, through the removal of the upper casing part, the machine is easily accessible for maintainance and repair purposes.

The holder for the container preferably comprises clips fixed to the bottom and which are preferably provided in each case with a base plate, which is screwed to the bottom. The retaining clips together with their base plate can be inserted into a profiled part of the bottom. Together with the base plate, they ensure an additional reinforcement of the bottom of the casing.

A further installation possibility is provided if the upper casing part has an upwardly directed step, the casing section located above the step, with smaller horizontal dimenions has a height which is the same or preferably greater than the thickness of a built-in plate. Thus, it is possible to install the machine under a built-in plate in such a way that the step is supported from the bottom on said plate. The top of the casing which is preferably substantially flat, apart from a feed opening and controls, terminates largely flush with the built-in plate, so that the machine is fully integrated into a corresponding piece of office furniture or the like. Ventilation slots or louvers are provided in the casing for cooling the motor. They are preferably located in the vicinity of the upper edge of the casing and openings can be provided on the casing side walls and the top. These louvers, which consequently overlap the upper edge of the machine, also act in the case of a surface-flush installation, in that they are free at the top and from there air can be sucked in or blown out.

Advantageously a stand can be associated with the machine and said stand has a frame running round the lower casing part and carrying the supporting shoulder. The stand has an unpartitioned inner area and is open or openable on at least one side. The inner area can be constructed as a transportation reception space for the possibly packed machine. For example, the opening can be formed by the insertion opening, into which the machine is introduced e.g. with a narrow side first. Thus, the stand simultaneously forms a pack or additional protection for the machine and storage and transportation space is saved. It is perfectly possible to separately pack the machine and insert it into the stand at the time of delivery, which makes it possible to reduce the number of types kept in stock. In spite of this, the advantage of transportation space saving and additional protection of the sensitive machine by the surrounding stand are retained. As has already been stated, the stand can comprise a simple frame passing round all the twelve edges and which can optionally be supplemented by plates or panels to form a cabinet. However, it is also possible to provide a differently constructed cabinet with openable doors.

Further advantages and features of the invention can be gathered from the following description in conjunction with the drawings. These features and those of the subclaims can be used either individually or in random combination in advantageous embodiments of the invention.

BRIEF DESCRIPTION OF THE DRAWINGS

An embodiment of the invention is described in non-limitative manner hereinafter relative to the drawings, wherein.

DETAILED DESCRIPTION OF THE INVENTION

Figure 1:
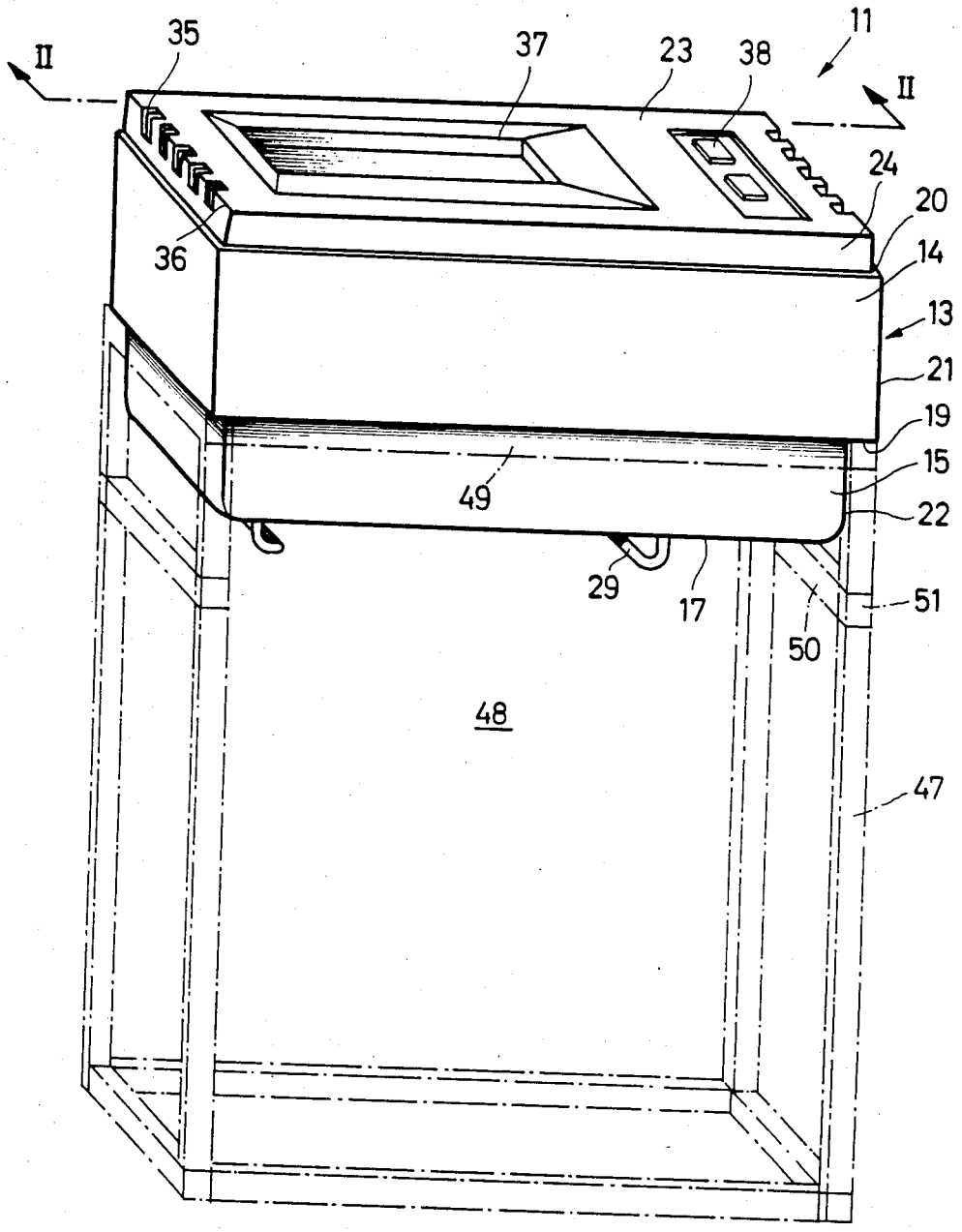
FIG. 1 is a perspective view of the machine with a stand indicated by dot-dash lines.

The machine shown in FIG. 1 is a shredding machine, into whose feed opening 37 can be thrown documents in paper or foil form, or complete sets of papers or documents. They are comminuted by a cutting mechanism in the machine and are ejected from a discharge opening 39 (FIG. 2) on the bottom of the machine.

The basically elongated, box-shaped casing 13 comprises two plastic parts, namely an upper casing part 14 and a lower casing part 15. Upper casing part 14 has side walls 21, which represent the largest external dimensions of the machine in horizontal extension. At a distance of a few centimetres from the upper edge 36 is provided an inwardly directed step 20, so that the casing section 24 positioned above the step is somewhat inwardly displaced. The substantially flat casing top 23 is interupted by the feed opening 37, which is surrounded by a somewhat downwardly directed, chamfered frame. There is also a somewhat countersunk control surface containing the controls 38, e.g. pushbuttons. Ventilation slots or louvers 35 are provided on the narrow sides in the vicinity of edges 36 and in each case extend in angular manner over the edge, so that they have ventilation openings on the top 23 and the circumferential casing sections 24.

The lower casing part 15 is shaped like a relatively flat trough with a basically flat bottom ribbed by profiles 27 and interrupted by the discharge openings 39. The side walls 22 of the lower casing part are inwardly displaced by a few centimetres compared with the side walls 21 of the upper casing part, so that lower casing part 15 has smaller external dimensions in the horizontal direction in this area. A horizontally outwardly directed supporting shoulder 19 is connected at the top to side walls 22 and passes into an upwardly directed edge 25. The latter is dimensioned appropriately for the side walls 21 of upper casing part 14, said side walls overlapping it and being fixed to it by screws 26.

Holders for a basket or container 33 are arranged in the vicinity of the upwardly directed profiles 27 on the bottom 17 of casing part 15. These holders are constituted by clips made from strong wire or round steel and are in each case fixed to a metal base plate 31, which is fitted by screws to bottom 17. The clips project downwards and inwards, so that the horizontally directed section 30 of the round steel clip forms a guide for the edge of container 33, into which the latter can be inserted. Container 33, which is indicated by a broken line, is provided centrally below the discharge opening 39, which is eccentrically positioned. However, broken lines also indicate that the clip can be positioned on the other outer edge of the lower casing part, so that a larger container can be used.

It is indicated by broken lines that there are components 41 within the casing, which can be individually fitted and adjusted on the base plate formed by the bottom of the lower casing part 15, before the upper casing part 14 is placed above the same.

FIG. 1 shows a stand 47, which comprises square tubes, which run along all twelve edges of the rectangularly defined body and are supported by lateral struts 50 on two narrow sides. The square tubes are interconnected by attachment fittings 51 and form on the top an all-round frame 49, whose internal dimensions match the side walls 22 of lower casing part 15 so that supporting shoulder 19 rests on said frame and receives the machine. A container for the materials to be comminuted is suspended in the space 48 formed in the stand by inserting into clips 29.

The side walls of stand 47, indicated by broken lines, can be closed by plates and it is optionally possible to place a door to be opened in the front side, so that a cabinet is formed. Thus, the stand merely forms a support, whilst all the parts belonging to the operation of the machine, including the container are located on the actual machine. The stopping member (not shown) comprising a pivotable flap can be positioned on the lower casing part. By means of the inserted container, said member can be pivoted from a position closing the discharge opening into an open position and can be further pivoted by the back pressure of the comminuted material, so that the machine is switched off. This member is described in greater detail in the simultaneously filed German Patent Application of the present Applicant entitled "Apparatus for comminuting materials, such as documents, etc.", and reference should be made thereto.

Figure 2:
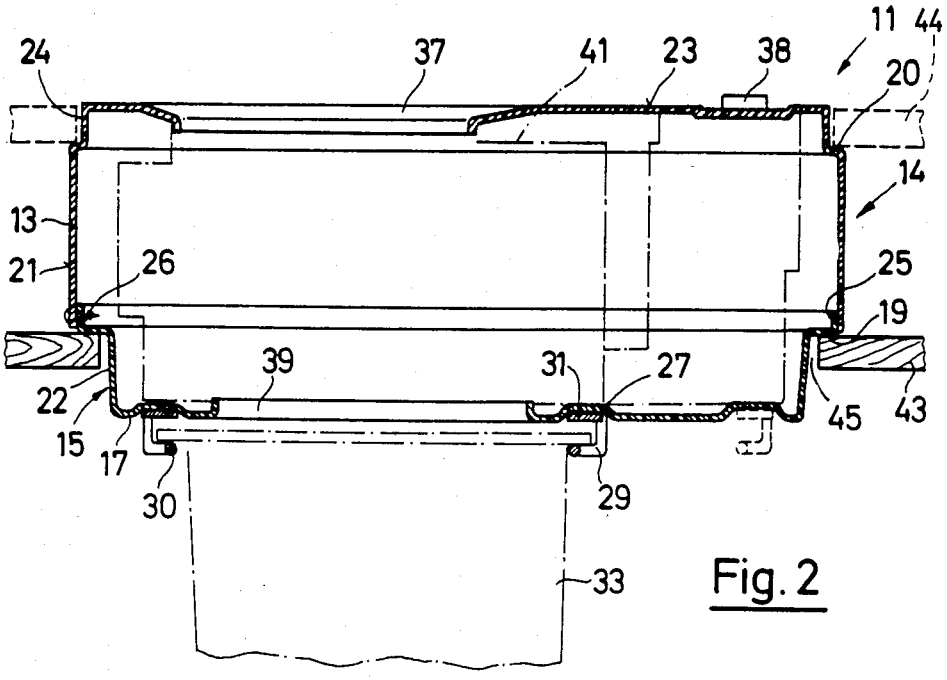
FIG. 2 is a section along a vertical plane indicated by line II in FIG. 1, the machine being received in the insertion opening of the built-in plate, a further installation possibility being indicated by the broken line.

FIG. 2 shows the installation in a builtin plate 43 of a table or another piece of office furniture. For this purpose it is merely necessary to cut into the built-in plate 43 an insertion opening appropriate for the dimensions of the lower casing part 15, whose edge forms the frame on which the supporting shoulder 19 rests. The machine does not have to be fixed in its insertion opening, because it is very securely centred and held. This is helped by the fact that as a result of the lowering of a large part of the casing to below the plane of the built-in plate, the centre of gravity is extremely low and even in the case of an accidental tilting of the piece of furniture, there is no tendency for the machine to drop out of the insertion opening. It is particularly clearly visible that the container is positioned well below the built-in plate, so that it is easily accessible for removal purposes.

FIG. 2 shows in broken line form a possibility of installation, in which the machine is inserted from below into the insertion opening of a built-in plate 44, the step 20 being supported on said plate at the bottom. The height of the casing section 24 is such that the top of the machine is surface-flush or somewhat above the plane of the built-in plate 44, so that a fully integrated installation is possible. Below the built-in plate, the machine is supported by corresponding clips or a bearing surface.

Figure 3:
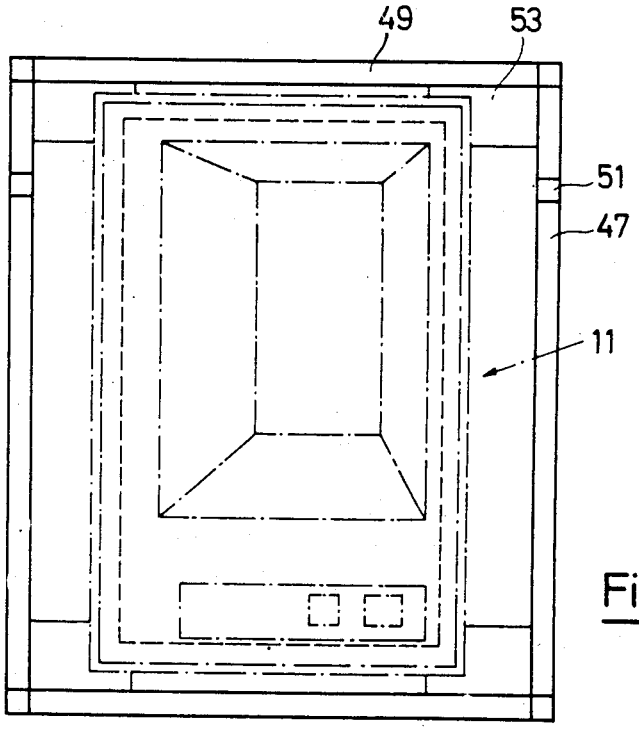
FIG. 3 is a machine installed in the stand.

FIG. 3 shows that the machine, indicated by broken lines, can be placed within the stand 47 for transportation purposes. When the framework is open, it can be introduced from any random side into the reception area 48 of the stand, provided that the stand dimensions are suitable for this. However, it is in all cases possible to insert through the insertion opening within the frame 49 the machine which has been turned twice by 90°, if it is ensured that the height dimensions of the machine are less than the width (the short horizontal side) and the latter is in turn less than the length dimensions (the longer horizontal side) between the side walls (22) of the lower part. The machine can be introduced through the insertion opening with a narrow side to the front, so that reception in space 48 is also possible in the case of a cabinet with closed sides and possibly a smaller door. The machine can be arranged within space 48, either in unpacked form, or in its own pack Conventional rigid foam angle brackets or supports 53 are indicated, which support the machine within stand 47. The size of the transportation space is significantly reduced, and the generally robust stand forms an additional protection for the machine during transportation. The packing can also be provided round the stand. The prerequisite for this possibility is merely that the greatest edge length of the stand (usually the height) is the same or somewhat larger than the largest dimension of the machine and that these conditions also apply with different edge lengths for the corresponding sides of the machine, e.g. wider stand larger than the smallest dimension of the machine and machine height somewhat less than the depth of the stand.

What is claimed is:

1. In a machine for comminuting paper, having a feed opening and a discharge opening end which is capable of insertion into an opening in a frame, the improvment comprising: a casing having an upper casing part and a separable lower casing part for supporting the apparatus on said frame, said upper casing part having larger dimensions in horizontal extension to said frame opening than the lower casing part, thereby forming an outwardly-directed supporting shoulder between the upper and the lower casing parts for supporting said machine in said framed opening dimensioned to receive the lower casing part, the opening being smaller than the upper casing part, a bottom of the lower casing part being provided with a discharge opening for comminuted material and having a holder for a container for the comminuted material, positioned below the lower casing part.

2. A machine according to claim 1, wherein the lower casing part represents at least a quarter of a overall height of the casing.

3. A machine according to claim 1, wherein the upper and lower casing parts are separable from one another adjacent the supporting shoulder.

4. A machine according to claim 3, wherein the lower casing part has an upwardly directed edge following on to the supporting shoulder and which is overlapped by the upper casing part.

5. A machine according to claim 1, wherein the bottom of the lower casing part is reinforced by profiling.

6. A machine according to claim 1, wherein the holder for the container comprises clips fixed to the bottom and which are preferably provided in each case with a base plate which is screwed to the bottom.

7. A machine according to claim 1, wherein the upper casing part has an upwardly-directed step, a casing section of the upper casing part located above the step having smaller horizontal dimensions than a remaining section defined by side walls of the upper casing part, the casing section having a height which is at least equal to a thickness of a built-in plate to be adjacent the step.

8. A machine according to claim 1, wherein the casing top surface is substantially flat, apart from a feed opening and controls.

9. A machine according to claim 1, wherein louvers are provided in the vicinity of an upper edge of the casing and preferably having openings on the casing side walls and on the top surface.

10. A machine according to claim 1, wherein a stand is associated with the machine, the stand having a frame defining the framed opening for carrying the supporting shoulder and the frame extending around the lower casing part, the stand having an unpartitioned inner space and the stand being accessible from at least one side, the inner space being constructed as a transportation reception area for the machine.

* * * * *

UNITED STATES PATENT AND TRADEMARK OFFICE

CERTIFICATE OF CORRECTION

PATENT NO. : 4,637,560

DATED : January 20, 1987

INVENTOR(S) : Albert Goldhammer

It is certified that error appears in the above-identified patent and that said Letters Patent is hereby corrected as shown below:

Column 1, line 15, delete "to" and insert --at--.

Column 6, line 2, delete "a" (second occurrence) and insert --the--.

Signed and Sealed this

Fifteenth Day of September, 1987

*Attest:*

DONALD J. QUIGG

*Attesting Officer*

*Commissioner of Patents and Trademarks*